US010045642B2

(12) United States Patent
Howard et al.

(10) Patent No.: US 10,045,642 B2
(45) **Date of Patent: *Aug. 14, 2018**

(54) MERCHANDISING SYSTEM AND METHOD OF USE

(71) Applicant: Display Technologies, LLC, Lake Success, NY (US)

(72) Inventors: Andrew Howard, Mamaroneck, NY (US); Stephen J. Cress, Baltimore, MD (US)

(73) Assignee: Display Technologies, Inc., Lake Success, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/671,478

(22) Filed: Aug. 8, 2017

(65) Prior Publication Data

US 2017/0332810 A1 Nov. 23, 2017

Related U.S. Application Data

(63) Continuation of application No. 15/201,918, filed on Jul. 5, 2016, now Pat. No. 9,723,933, which is a (Continued)

(51) Int. Cl.
*A47F 7/28* (2006.01)
*A47F 1/12* (2006.01)
(Continued)

(52) U.S. Cl.
CPC ..... *A47F 7/281* (2013.01); *A47B 65/15* (2014.12); *A47B 73/006* (2013.01); *A47F 1/04* (2013.01);
(Continued)

(58) Field of Classification Search
CPC .... A47F 1/126; A47F 1/12; A47F 1/04; A47F 1/125; A47F 1/128; A47F 7/28;
(Continued)

(56) References Cited

U.S. PATENT DOCUMENTS 1,736,057 A 11/1929 Smith
4,685,574 A 8/1987 Young et al.
(Continued)

FOREIGN PATENT DOCUMENTS

WO WO 2007133086 A1 * 11/2007 ..... A47F 1/12

OTHER PUBLICATIONS

Canadian Office Action dated Oct. 26, 2017 issued in corresponding Canadian Application No. 2,924,314.

*Primary Examiner* — Patrick D Hawn
(74) *Attorney, Agent, or Firm* — Andrus Intellectual Property Law, LLP

(57) ABSTRACT

A guide assembly for a displaying a plurality of products is disclosed. The guide assembly includes a base, a first lateral wall and a second lateral wall. The base includes a product-supporting surface defining a longitudinal axis. Each lateral wall includes a plurality of support members and a rail. The support members extend upwardly from a lateral side of the base. The rail is spaced above the base and extends along portions of the support members. A proximal-most support member of the first lateral wall is longitudinally offset from a proximal-most support member of the second lateral wall.

11 Claims, 8 Drawing Sheets

Related U.S. Application Data continuation of application No. 14/026,356, filed on Sep. 13, 2013, now Pat. No. 9,380,889.

(51) Int. Cl.

| | |
|---|---|
| ***A47B 73/00*** | (2006.01) |
| ***A47F 5/00*** | (2006.01) |
| ***A47F 1/04*** | (2006.01) |
| ***A47F 7/00*** | (2006.01) |
| ***A47B 65/00*** | (2006.01) |

(52) U.S. Cl.
CPC ..... *A47F 1/12* (2013.01); *A47F 5/005* (2013.01); *A47F 7/0007* (2013.01); *A47F 7/28* (2013.01)

(58) Field of Classification Search
CPC ..... A47F 7/281; A47F 7/0007; A47F 5/005; A47F 5/0025; A47F 3/14; A47B 65/15; A47B 73/006
USPC ..... 211/59.2, 59.3, 74
See application file for complete search history.

(56) References Cited

U.S. PATENT DOCUMENTS 4,763,963 A * 8/1988 Lauffer ..... A47F 1/08 221/281
4,785,945 A * 11/1988 Rowse ..... A47F 1/12 108/64
5,240,126 A * 8/1993 Foster ..... A47F 1/126 211/175
5,531,336 A * 7/1996 Parham ..... A47F 5/005 211/183
5,634,564 A * 6/1997 Spamer ..... A47F 1/126 211/175
5,685,664 A * 11/1997 Parham ..... A47F 1/126 211/59.3
5,806,690 A * 9/1998 Johnson ..... A47F 1/126 211/175
6,082,556 A * 7/2000 Primiano ..... A47F 1/12 211/59.2
6,142,316 A * 11/2000 Harbour ..... A47F 1/12 211/59.2
6,276,538 B1 * 8/2001 Battaglia ..... A47F 1/12 108/108
6,325,221 B2 * 12/2001 Parham ..... A47F 1/12 211/183
6,715,621 B2 * 4/2004 Boron ..... A47F 1/12 211/175
6,719,152 B1 * 4/2004 Nagel ..... A47F 1/126 211/59.3
7,681,744 B2 * 3/2010 Johnson ..... A47F 1/126 211/59.3
7,690,519 B2 * 4/2010 Kahl ..... A47F 1/12 211/126.1
7,823,734 B2 * 11/2010 Hardy ..... A47F 1/126 211/59.3
7,854,333 B2 * 12/2010 Kottke ..... A47F 1/12 211/59.2
8,038,018 B1 * 10/2011 Breitenbach ..... G07F 11/36 211/59.3
8,056,734 B2 * 11/2011 Menz ..... A47F 1/12 211/59.2
8,162,154 B2 4/2012 Trulaske, Sr.
8,312,999 B2 * 11/2012 Hardy ..... A47F 1/126 211/59.3
8,360,253 B2 * 1/2013 Hardy ..... A47F 1/126 211/59.3
8,469,205 B1 * 6/2013 Hardy ..... A47F 1/126 211/59.3
8,550,262 B2 * 10/2013 Hardy ..... A47F 1/126 211/59.3
8,739,984 B2 * 6/2014 Hardy ..... A47F 1/126 211/119.003
8,863,963 B2 * 10/2014 Hardy ..... A47F 1/126 211/119.003
9,107,516 B2 * 8/2015 Pichel ..... A47F 1/04
2004/0020877 A1 * 2/2004 Boron ..... A47F 1/12 211/59.2
2004/0065631 A1 * 4/2004 Nagel ..... A47F 1/126 211/59.3
2005/0092702 A1 5/2005 Nagel
2005/0127014 A1 * 6/2005 Richter ..... A47F 1/126 211/59.2
2012/0266437 A1 * 10/2012 Camello ..... A47F 1/125 29/428

* cited by examiner

MERCHANDISING SYSTEM AND METHOD OF USE

CROSS-REFERENCE TO RELATED APPLICATION

The present application is a continuation of U.S. patent application Ser. No. 15/201,918 filed on Jul. 5, 2016, which is a continuation of U.S. patent application Ser. No. 14/026,356, now U.S. Pat. No. 9,380,889, filed on Sep. 13, 2013, the entire contents of each of which is incorporated by reference herein.

BACKGROUND

The present disclosure relates generally to a merchandising system for displaying products on a shelf. More particularly, the present disclosure relates to a merchandising system and method for storing and/or displaying products to provide for the space-efficient presentation of groups of products within a given or fixed display area, and/or allowing for convenient and orderly presentation, dispensing, and storage of products.

Various types of product merchandisers are commonly used in retail environments to display different types of products. As opposed to simply positioning products on shelves, product displays are commonly used to position products on a shelf in manner which automatically advances (e.g., via gravity or a pusher) a trailing or distal product (i.e., a product that is behind a lead or proximal-most product) closer to a consumer once the lead product has been removed from the shelf. As can be appreciated, such product displays facilitate the arrangement and upkeep of products, as the trailing products do not have to be manually moved toward the front of the shelf, for instance.

SUMMARY

The present disclosure relates to a guide assembly for a displaying a plurality of products. The guide assembly includes a base, a first lateral wall and a second lateral wall. The base includes a product-supporting surface defining a longitudinal axis. Each lateral wall includes a plurality of support members and a rail. The support members extend upwardly from a lateral side of the base. The rail is spaced above the base and extends along portions of the support members. A proximal-most support member of the first lateral wall is longitudinally offset from a proximal-most support member of the second lateral wall.

In disclosed embodiments, each of the support members of the first lateral wall are longitudinally offset from each of the support members of the second lateral wall. It is further disclosed that an entirety of each of the support members of the first lateral wall are longitudinally offset from an entirety of each of the support members of the second lateral wall.

In disclosed embodiments, adjacent support members of the first lateral wall are separated by a first distance, and adjacent support members of the second lateral wall are separated by the first distance. Here, it is disclosed that corresponding support members of the first lateral wall and support members of the second lateral wall are longitudinally offset by a second distance. The second distance is equal to about half of the first distance.

The present disclosure also relates to a merchandising system for a displaying a plurality of products. The merchandising system comprises a first guide assembly and a second guide assembly. Each guide assembly includes a base, a first lateral wall and a second lateral wall. Each base includes a product-supporting surface which defines a longitudinal axis. Each first lateral wall includes a plurality of support members and a rail. The support members extend upwardly from a first lateral side of each base. Each rail is spaced above each base and extends along portions of the support members. Each second lateral wall includes a plurality of support members and a rail. The support members extend upwardly from a second lateral side of each base. Each rail is spaced above each base and extends along portions of the support members. In each guide assembly, a proximal-most support member of the first lateral wall is longitudinally offset from a proximal-most support member of the second lateral wall. The first lateral wall of the second guide assembly is disposed alongside and in contact with the second lateral wall of the first guide assembly.

In disclosed embodiments, each of the support members of the first lateral wall of each guide assembly are longitudinally offset from each of the support members of the second lateral wall of each guide assembly. Here, it is disclosed that an entirety of each of the support members of the first lateral wall of each guide assembly are longitudinally offset from an entirety of each of the support members of the second lateral wall of each guide assembly.

In disclosed embodiments, adjacent support members of the first lateral wall of each guide assembly are separated by a first distance, and adjacent support members of the second lateral wall of each guide assembly are separated by the first distance. Here, it is disclosed that corresponding support members of the first lateral wall of each guide assembly and support members of the second lateral wall of each guide assembly are longitudinally offset by a second distance. The second distance is equal to about half of the first distance.

In disclosed embodiments, each support member of the first lateral wall of the second guide assembly is longitudinally aligned with a corresponding support member of the second lateral wall of the first guide assembly. Here, it is disclosed that each support member of the first lateral wall of the first guide assembly is longitudinally aligned with a corresponding support member of the second lateral wall of the second guide assembly.

In disclosed embodiments, the merchandising system further comprises a plurality of products on each base of each guide assembly. A portion of a first product beneath the rail of the first guide assembly is configured to contact a portion of a second product beneath the rail of the second guide assembly. It is further disclosed that a lateral-most edge of a first product is configured to contact an inside wall of a first support member of the first guide assembly when the product is in a first position on the base of the first guide assembly, and a lateral-most edge of the first product is configured to extend laterally outward of the inside wall of the first support member of the first guide assembly when the product is in a second position on the base of the first guide assembly. It is further disclosed that at least one of the products has a diameter that is larger than a perpendicular distance between an inner wall of the rail of the first lateral wall of the first guide assembly and an inner wall of the rail of the second lateral wall of the first guide assembly.

The present disclosure also relates to a method of advancing products on a merchandising system. The method comprises providing a guide assembly including a base, a first lateral wall and a second lateral wall. The base includes a product-supporting surface defining a longitudinal axis. The first lateral wall includes a plurality of support members and a rail. The support members extend upwardly from a first lateral side of the base, and the rail is spaced above the base and extends along portions of the support members. The second lateral wall includes a plurality of support members and a rail. The support members extend upwardly from a second lateral side of the base, and the rail is spaced above the base and extends along portions of the support members. A proximal-most support member of the first lateral wall is longitudinally offset from a proximal-most support member of the second lateral wall. The method further comprises positioning at least one product on the base. The product has a diameter that is larger than a perpendicular distance between an inner wall of the rail of the first lateral wall and an inner wall of the rail of the second lateral wall. The method also comprises advancing the product along a non-linear path along the base.

In disclosed embodiments, the method further comprises advancing the product in a zigzag path along the base.

BRIEF DESCRIPTION OF DRAWINGS

Embodiments of the present disclosure are described hereinbelow with reference to the drawings wherein.

DESCRIPTION

Figure 1:
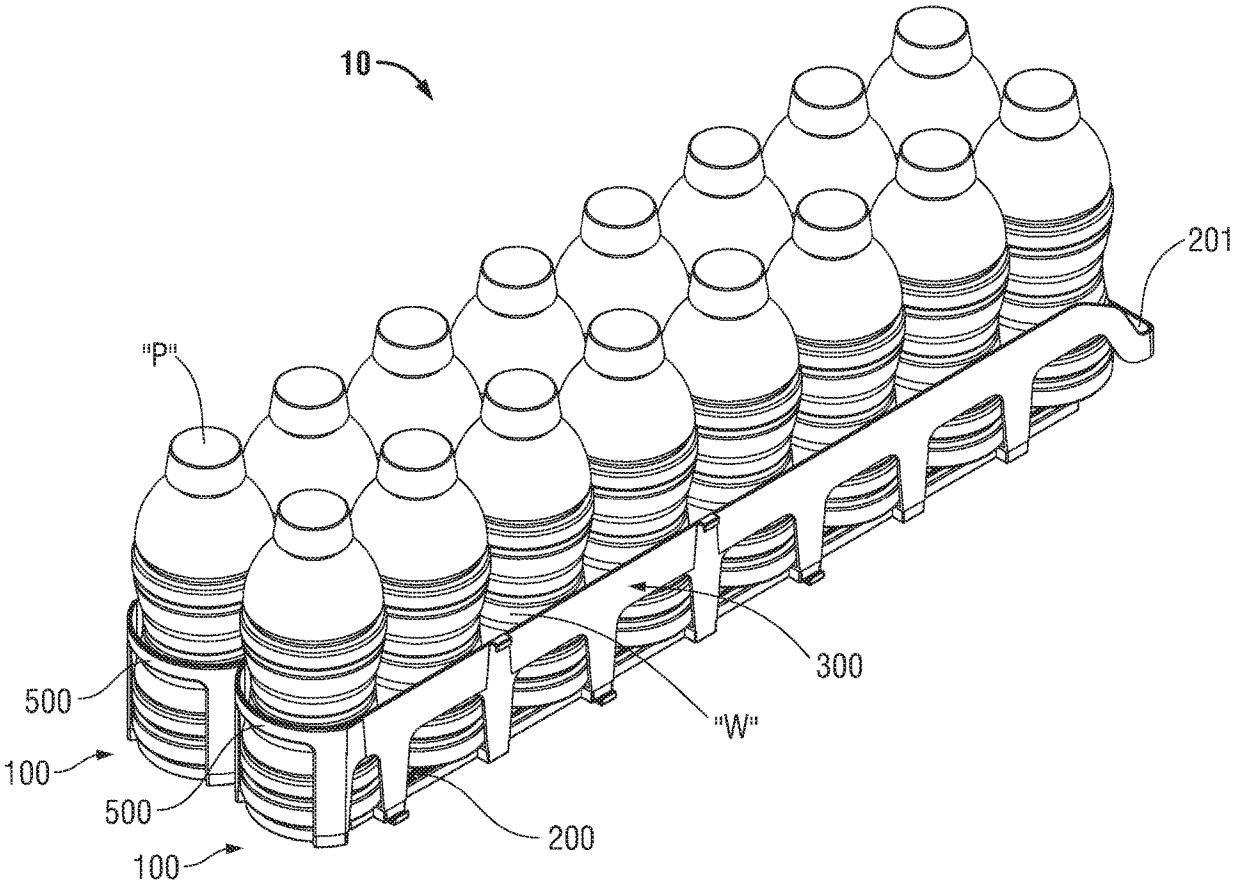
FIG. 1 is a perspective view of a merchandising system for displaying items on a shelf according to embodiments of the present disclosure, the merchandising system is illustrated including two guide assemblies with each guide assembly including a plurality of products thereon.

Embodiments of the presently disclosed merchandising system are described in detail with reference to the drawings wherein like numerals designate identical or corresponding elements in each of the several views. As is common in the art, the term "proximal" refers to that part or component closer to the user, e.g., customer, while the term "distal" refers to that part or component farther away from the user.

Generally, a merchandising system 10 is disclosed that includes a plurality of guide assemblies 100. In the illustrated embodiments, each guide assembly 100 includes a base 200, a first lateral guide 300, a second lateral guide 400, and a proximal member 500. While the illustrated embodiments show each guide assembly 100 configured for merchandising one row of products "P," it is envisioned and within the scope of the present disclosure that each guide assembly 100 is configured for merchandising more than one row of products "P."

Figure 8:
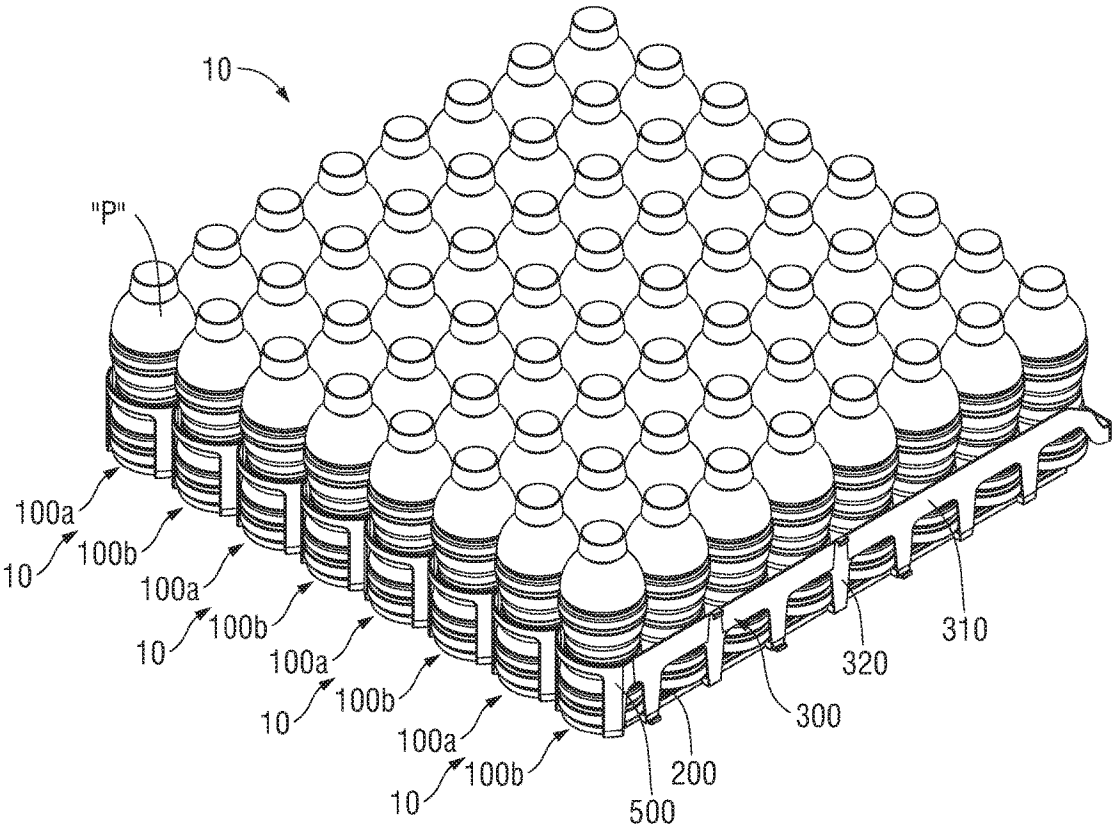
FIG. 8 is a perspective view of a merchandising system including eight guide assemblies with each guide assembly including a plurality of products thereon.

One merchandising system 10 includes a plurality of side-by-side guide assemblies 100. As can be appreciated, merchandising system 10 can include any number of guide assemblies 100. Adjacent guide assemblies 100 may mechanically engage one another (e.g., via a snap-fit connection), or may be positioned next to each other without mechanically engaging. Additionally, several merchandising systems 10 are able to be positioned adjacent one another on at least one shelf (see FIG. 8).

The base 200 is designed to be placed on a horizontal or inclined store shelf (or to be secured to a gondola). The base 200 includes a product-supporting surface 210 defining a longitudinal axis A-A and is configured to support products "P" thereon. In particular, it is envisioned merchandising system 10 is configured to support products "P" including a waist "W." More particularly, a product "P" includes a waist "W" when a lower portion of the product "P" includes a larger diameter than a portion thereabove; the smaller-diameter portion above the lower portion is the waist "W." See FIG. 1, for example. Many 2-liter bottles, 28-ounce bottles, and sport drink bottles include waists, for instance. In addition to supporting products with waists, merchandising system 10 can be used to support other types of products.

The lateral guides 300 and 400 are disposed in mechanical cooperation with base 200 (e.g., are integrally formed therewith, connectable thereto, etc.) and help maintain the products "P" on the base 200. A distal wall 201 extends between distal ends of first lateral guide 300 and second lateral guide 400, and is also configured to help maintain the products "P" on the base 200. The proximal member 500 is disposed in mechanical cooperation (e.g., via a snap-fit connection) with a proximal portion 202 of base 200 and is also configured to help maintain the products "P" on the base 200.

Figure 2:
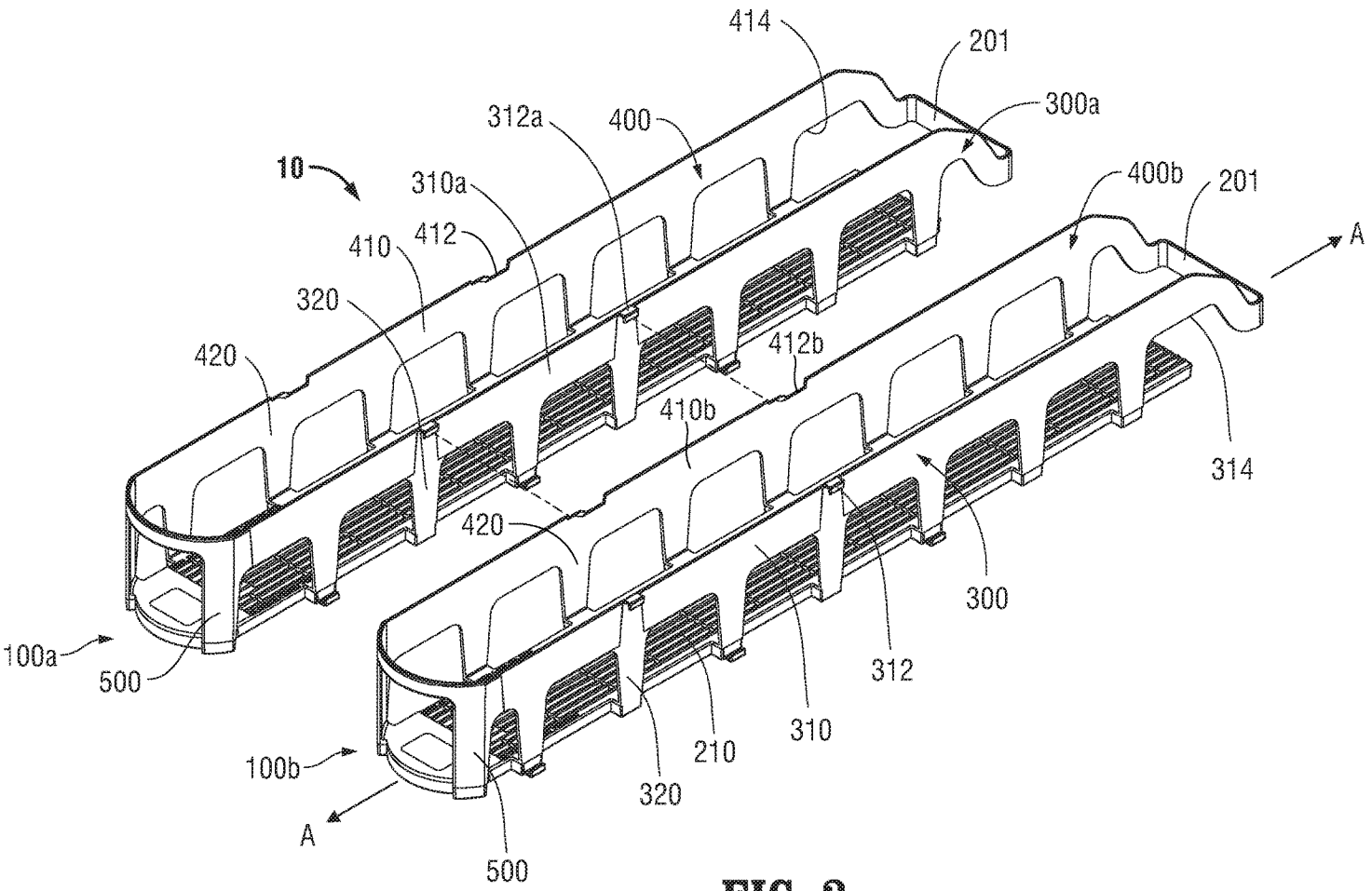
FIG. 2 is a perspective view of the merchandising system of FIG. 1 showing a first guide assembly separated from a second guide assembly, with each guide assembly illustrated with no products thereon.

With particular reference to FIG. 2, each lateral guide 300, 400 includes a rail 310, 410, respectively, and a plurality of support members 320, 420, respectively. Support members 320, 420 extend upward from base 200, and each rail 310, 410 extends along upper portions of the support members 320, 420, respectively. Additionally, in the embodiment illustrated in FIG. 2, each rail 310, 410 includes an engagement feature 312, 412, respectively, that is configured to releasably attach to a rail positioned thereagainst. For instance, and with particular reference to FIG. 2, a first guide assembly 100*a* includes a lateral guide 300*a* having an engagement feature 312*a* on its rail 310*a*, which is configured to releasably attach to the rail 410*b* of a lateral guide 400*b* of an adjacent, second guide assembly 100*b*.

Figure 3:
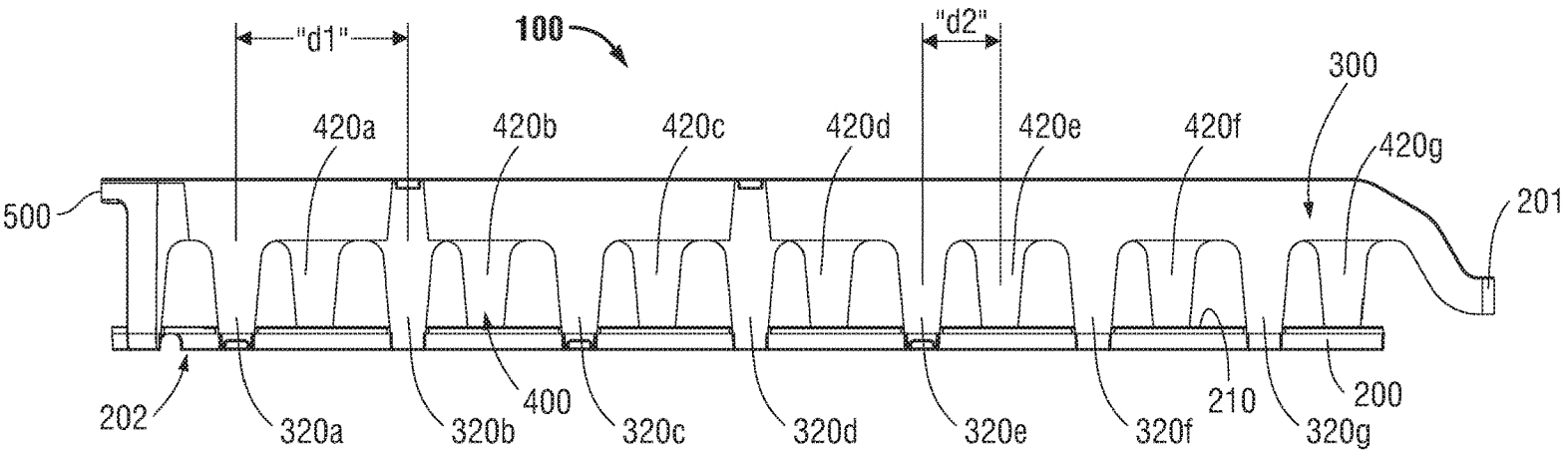
FIG. 3 is a side view of a guide assembly of the present disclosure.
Figure 4:
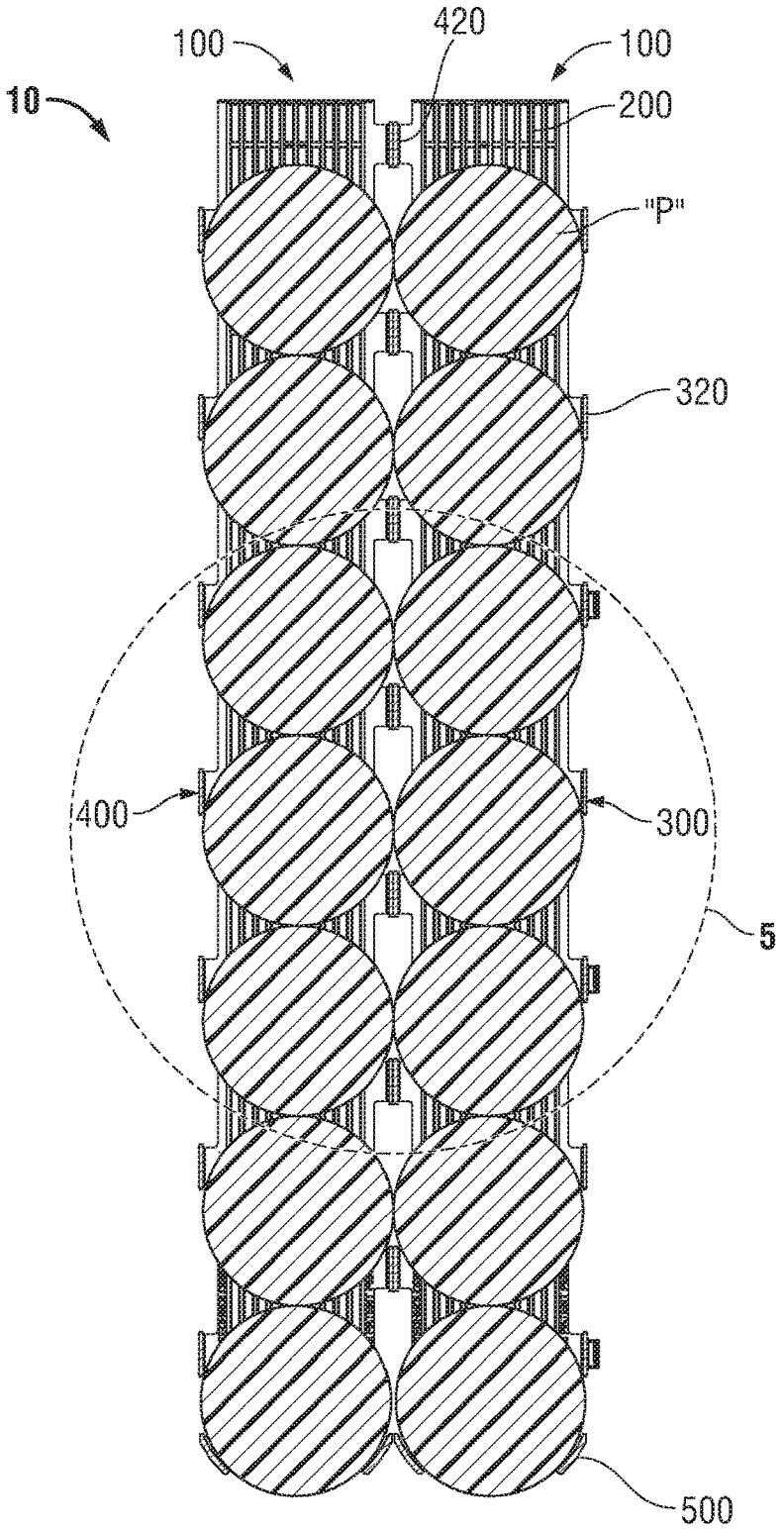
FIG. 4 is a top view of the merchandising system of the present disclosure including two guide assemblies with each guide assembly including a plurality of products thereon.

As shown in FIGS. 2-4, for example, support members 320 of first lateral guide 300 are longitudinally offset from corresponding support members 420 from second lateral guide 400. That is, with regard to the guide assembly 100 shown in FIG. 3 (i.e., which has same orientation as guide assembly 100*b* in FIG. 2), a first, proximal-most support member 320*a* of lateral guide 300 is closer to proximal member 500 than a first, proximal-most support member 420*a* of lateral guide 400. (Guide assembly 100*a* is a mirror image of guide assembly 100*b*, such that in guide assembly 100*a* (as shown in FIG. 2), support member 420*a* of lateral guide 400 is closer to proximal member 500 than support member 320*a* of lateral guide 300; also see FIG. 3.) Additionally, the remaining support members 320*b*-320*g* of lateral guide 300 of the guide assembly 100 (e.g., guide assembly 100*b* in FIG. 2) are also longitudinally offset and closer to proximal member 500 than corresponding support members 420*b*-420*g* of lateral guide 400. In the illustrated embodiments, the distance "d1" between adjacent support members 320 of lateral guide 300 is the same as the distance between adjacent support members 420 of lateral guide 400. It is further shown that the distance "d2" of the longitudinal offset between corresponding support members 320*a-g* and 420*a-g* is approximately half of the distance "d1" (as measured from longitudinal centers of the support members 320, 420; see FIG. 3). For example, it is envisioned that "d1" is equal to about 3.47 inches, and that "d2" is equal to about 1.58 inches and "d1."

Figure 5:
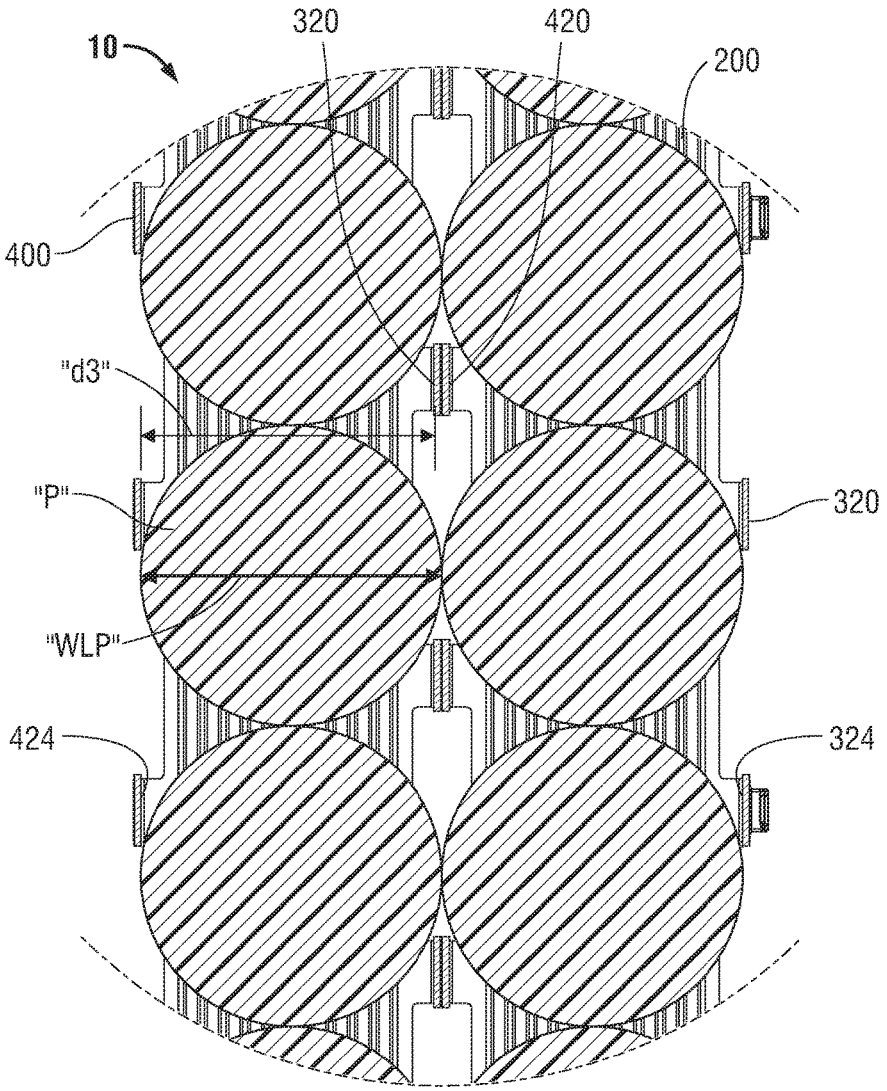
FIG. 5 is an enlarged view of the area of detail indicated in FIG. 4 illustrating the products in a first position.
Figure 6:
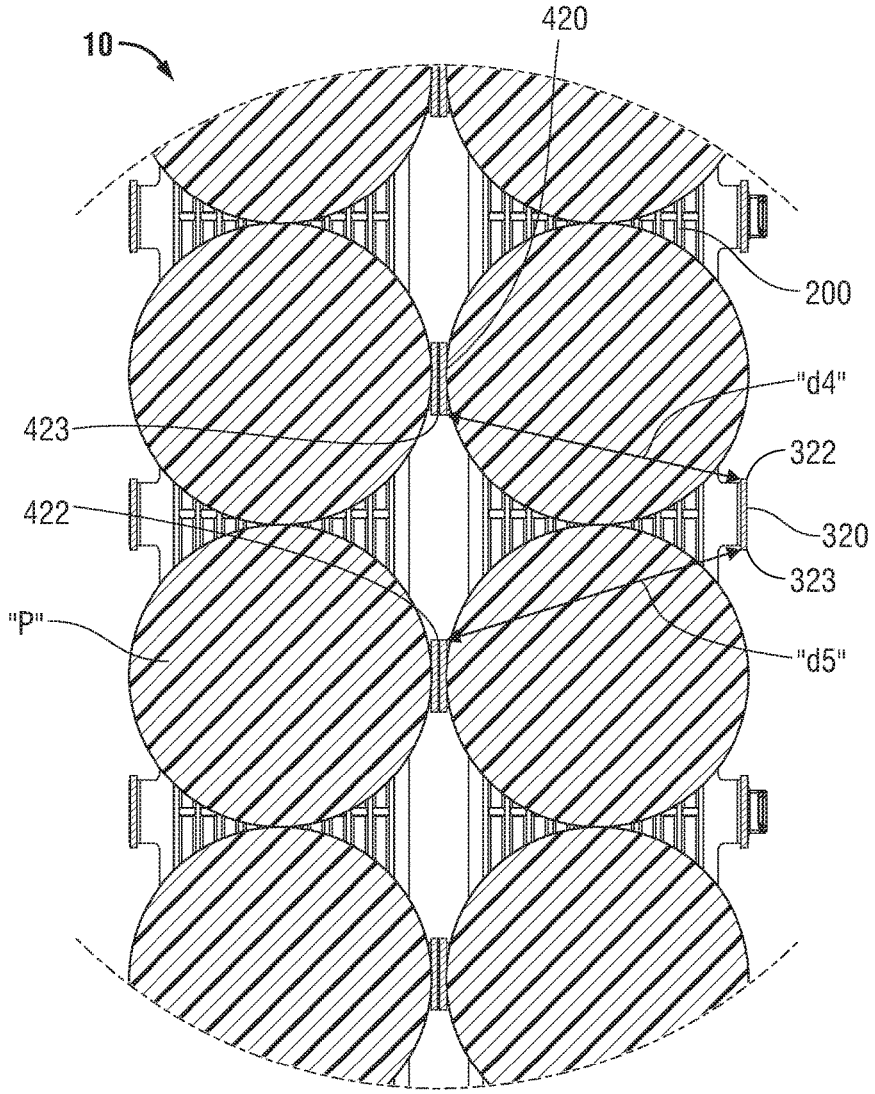
FIG. 6 is the view of the merchandising system of FIG. 5 illustrating the products in a second position.

The longitudinally offset, or staggered configuration of support members 320 and 420 allow the perpendicular distance "d3" between inner walls 324 and 424 of support members 320 and 420, respectively, to be smaller than the width of the lower portion "WLP" of the product "P" supported therebetween while still permitting outer walls of rails (e.g., 310*a* and 410*b* in FIG. 2) of adjacent guide assemblies 100 to be positioned in contact with each other (see FIG. 5). It is disclosed that the inner walls 324 of support member 320 are aligned with an inner wall of rail 310, and that the inner walls 424 of support members 420 are aligned with an inner wall of rail 420.

Figure 7:
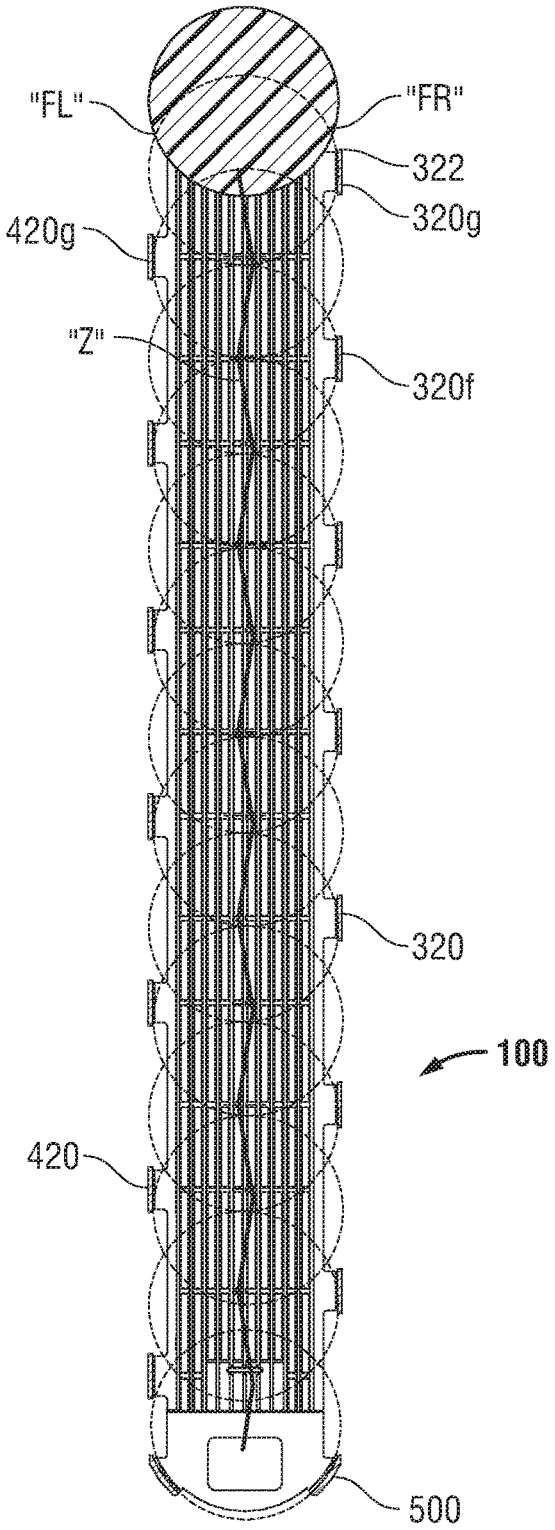
FIG. 7 is a top view of one guide assembly of the merchandising system illustrating the path of a product moving therealong.

When products "P" having a lower portion with a width "WLP" that is larger than the perpendicular distance "d3" (see FIG. 5) are placed on product-supporting surface 210 of base 200, the products "P" move proximally in a non-linear or zigzag path "Z" (see FIG. 7). More particularly, and with continued reference to FIG. 7, when a product "P" is urged proximally (e.g., via gravity or a pusher) from a distal portion of base 200, a front-right side "FR" of the product "P" contacts a distal portion 322 of support 320*g*, which causes the product "P" to move diagonally away from support 320*g* and diagonally toward support 420*g*. A front-left side "FL" of the product "P" then contacts a distal portion 422 of support 420*g*, which causes the product "P" to move diagonally away from support 420*g* and diagonally toward support 320*f* (i.e., between support 420*g* and support 320*g*). This diagonal or zigzag movement of the product "P" continues until the product "P" contacts proximal member 500. As shown, the staggered orientation of supports 320 and 420 enables lateral edges of the lower portion of the product "P" to travel laterally outward of inner wall 324 of each support 320, laterally outward of inner wall 424 of each support 420, and into contact with a product "P" on an adjacent guide assembly 100, for example (see FIG. 5, for instance).

The diagonal or zigzag movement of the products "P" requires less perpendicular distance "d3" between rails 310 and 410, and thus necessitates a narrower guide assembly 100 to enable a product "P" to travel proximally with respect to a linearly-travelling product. As can be appreciated, it is often desirable to fit as many guide assemblies on a store shelf as possible. In disclosed embodiments, the perpendicular distance "d3" between rails 310 and 410 is between about 3 inches and about 4 inches (e.g., equal to about 3.4 inches). Here, in the embodiments where "d3" is equal to about 3.4 inches, the diagonal distance "d4" between distal portion 322 of support 320 and a proximal portion 423 of support 420 is equal to about 3.6 inches, and the diagonal distance "d5" between distal portion 422 of support 420 and a proximal portion 323 of support 320 is equal to about 3.5 inches. (See FIG. 5.) In these embodiments, it is further envisioned that "WLP" is approximately equal to about 3.4375 inches (i.e., about 1/16" smaller than "d5"). It is envisioned that having distances "d4" and "d5" being different from each other enable the thickness of supports 320 and 420 to be maximized, while still enabling a relatively narrow guide assembly 100. It is further envisioned that distances "d4" and "d5" are equal to each other.

It is envisioned that a lower edge 314, 414 (FIG. 2) of rails 310, 410, respectively, is spaced from between about 1 inch and about 2 inches (e.g., equal to about 1.75 inches) from product-supporting surface 210 of base 200. It is further envisioned that the height of rails 310, 410 can be customized to match the waist "W" of a particular product "P" designed to be supported by guide assembly 100.

It is further envisioned that at least a portion of proximal member 500 is transparent or translucent to allow a consumer to view a portion of the proximal-most product "P" on the merchandising system 10 therethrough.

It is further envisioned that guide assembly 100 includes a pusher assembly configured to urge product(s) "P" on base 200 toward proximal member 500. Further details of a pusher assembly are included in commonly-owned U.S. Pat. No. 7,703,614 to Jay, et al., which was filed on Jan. 25, 2007, the entire contents of which being incorporated by reference herein.

The present disclosure also includes a method of displaying and merchandising items or products using the merchandising system 10 described above. The present disclosure also includes a system including the merchandising system 10 described above along with particular products, such as those described above.

While several embodiments of the disclosure have been shown in the figures, it is not intended that the disclosure be limited thereto, as it is intended that the disclosure be as broad in scope as the art will allow and that the specification be read likewise. Therefore, the above description should not be construed as limiting, but merely as exemplifications of various embodiments. Those skilled in the art will envision other modifications within the scope and spirit of the claims appended hereto.

The invention claimed is:

1. A merchandising system including a first guide assembly for a displaying a first plurality of products and a second guide assembly for displaying a second plurality of products, the first guide assembly comprising:

a base including a product-supporting surface, the product-supporting surface of the base defining a longitudinal axis;

a first plurality of support members including at least three support members, each support member of the first plurality of support members extends upwardly from a first lateral side of the base; and a second plurality of support members, each support member of the second plurality of support members extends upwardly from a second lateral side of the base, wherein each support member of the first plurality of support members is longitudinally offset from each support member of the second plurality of support members, and wherein a lateral distance between corresponding support members of the first plurality of support members and support members of the second plurality of support members is fixed, wherein adjacent support members of the first plurality of support members are separated by a first distance, wherein a longitudinal offset between corresponding support members of the first plurality of support members and support members of the second plurality of support members is a second distance, the second distance being equal to about half the first distance; and the second guide assembly being a substantial mirror image of the first guide assembly, wherein a product of the first plurality of products positioned on the base of the first guide assembly is configured to contact a product of the second plurality of products positioned on a base of the second guide assembly.

2. The merchandising system according to claim 1, wherein an entirety of each support member of the first plurality of support members of the first guide assembly is longitudinally offset from each support member of the second plurality of support members.

3. The merchandising system according to claim 1, wherein adjacent support members of the first plurality of support members of the first guide assembly are configured to allow at least a portion of a single product to fit therebetween.

4. The merchandising system according to claim 1, wherein each support member of the first plurality of support members of the first guide assembly is fixed from lateral movement with respect to the base.

5. The merchandising system according to claim 4, wherein each support member of the second plurality of support members of the first guide assembly is fixed from lateral movement with respect to the base.

6. The merchandising system according to claim 1, wherein each support member of the first plurality of support members of the first guide assembly is configured to contact a product on the product-supporting surface of the base of the first guide assembly.

7. The merchandising system according to claim 1, wherein the first plurality of support members of the first guide assembly is included on a first lateral wall, the first lateral wall including a first rail spaced above the base and extending along portions of each support member of the first plurality of support members, wherein the second plurality of support members of the first guide assembly is included on a second lateral wall, and the second lateral wall includes a second rail spaced above the base and extending along portions of each support member of the second plurality of support members.

8. The merchandising system according to claim 7, wherein a lateral distance between the first rail and the second rail of the first guide assembly is fixed.

9. A method of advancing products on a merchandising system, the method comprising:

positioning a first product on a base of a first guide assembly, wherein the first product defines a diameter, the diameter of the first product being larger than a first lateral distance defined between two adjacent sidewalls of the guide assembly, wherein the first lateral distance is uniform between a proximal portion of the base and a distal portion of the base;

advancing the first product in a zigzag path along the base;

positioning a second guide assembly adjacent to and in contact with the first guide assembly, the second guide assembly being a substantial mirror image of the first guide assembly; and positioning a second product on a base of the second guide assembly and in contact with the first product.

10. A method of positioning products on a merchandising system, the method comprising:

positioning a first product on a base of a first guide assembly, wherein the first product defines a diameter, the diameter of the first product being larger than a first lateral distance defined between two adjacent sidewalls of the guide assembly such that the two adjacent sidewalls physically prevent the first product from moving in a linear path from a distal end of the base to a proximal end of the base, wherein the first lateral distance is uniform along an entire length of the base;

positioning a second product on a base of a second guide assembly, wherein sidewalls of the second guide assembly prevent the second product from moving in a linear path from a distal end of the base of the second guide assembly to a proximal end of the base of the second guide assembly; and positioning the second product in contact with the first product while the second product is on the base of the second guide assembly and while the first product is on the base of the first guide assembly.

11. The method according to claim 10, wherein positioning the first product includes the two adjacent sidewalls preventing the first product from moving in a non-zigzag path from a distal end of the base to a proximal end of the base.

* * * * *